US006474488B1

(12) United States Patent
Sullivan

(10) Patent No.: US 6,474,488 B1
(45) Date of Patent: Nov. 5, 2002

(54) ELECTRICAL CONTACT COUPLING FOR AUTOMATIC CENTER- OR CENTRAL BUFFER COUPLINGS FOR RAIL VEHICLES

(75) Inventor: John Sullivan, Wokingham (GB)

(73) Assignee: Scharfenbergkupplung GmbH & Co. KG (DE)

( * ) Notice: Subject to any disclaimer, the term of this patent is extended or adjusted under 35 U.S.C. 154(b) by 0 days.

(21) Appl. No.: 09/590,336

(22) Filed: Jun. 8, 2000

(30) Foreign Application Priority Data

Jun. 8, 1999 (DE) ..... 199 26 058

(51) Int. Cl.[7] ..... B61G 1/06
(52) U.S. Cl. ..... 213/1.3; 439/135; 105/3
(58) Field of Search ..... 213/1.3, 1.6, 76; 248/53, 67; 105/3; 439/135, 138, 139, 578

(56) References Cited

U.S. PATENT DOCUMENTS

| | | | | | |
|---|---|---|---|---|---|
| 915,894 | A | * | 3/1909 | Senecal | 213/1.3 |
| 1,644,975 | A | * | 10/1927 | Barber | 213/1.6 |
| 1,901,917 | A | * | 3/1933 | McCune | 213/1.3 |
| 2,052,993 | A | * | 9/1936 | Tomlinson | 213/1.3 |
| 3,552,580 | A | * | 1/1971 | Cope | 213/1.3 |
| 3,684,106 | A | * | 8/1972 | Baronnet et al. | 213/76 |
| 3,854,597 | A | * | 12/1974 | McClure et al. | 213/76 |
| 3,941,253 | A | * | 3/1976 | Ksiensyk et al. | 213/1.3 |
| 4,059,322 | A | * | 11/1977 | Fellner | 339/44 R |
| 4,232,793 | A | * | 11/1980 | Hallam et al. | 213/43 |
| 4,722,697 | A | * | 2/1988 | Naruse et al. | 439/310 |
| 5,362,261 | A | * | 11/1994 | Puerner | 439/752 |
| D399,187 | S | * | 10/1998 | Kay | D13/146 |

* cited by examiner

*Primary Examiner*—S. Joseph Morano
*Assistant Examiner*—Frantz F. Jules
(74) *Attorney, Agent, or Firm*—McGlew and Tuttle, P.C.

(57) ABSTRACT

An electrical contact coupling (3) is provided for automatic center- or central buffer couplings for rail vehicles, more particularly for claw couplings with protective arm, rotatable claw and fall bar of the "AAR" or "Janney" type or with two rigid claws and claw bar of the "Willison" type. The coupling has a contact carrier (8) secured to the coupling head and guided so as to be displaceable longitudinally in the longitudinal direction of the center buffer coupling. An economic and flat-construction solution, indicated for a center- or central buffer coupling of the aforementioned type, for the design and arrangement of an electrical contact coupling (3) and an air line coupling (12) is achieved wherein the longitudinally displaceable contact carrier (8) is arranged underneath and on a supporting unit (1) which for its part is elastically supported on and secured to the coupling head underneath the said coupling head. At least one actuating cylinder (6) is arranged within the supporting unit (1) for the longitudinal displacement of the contact carrier (8). An air coupling (12) with an orifice (11) is arranged on the supporting unit (1) in the coupling plane.

20 Claims, 3 Drawing Sheets

ELECTRICAL CONTACT COUPLING FOR AUTOMATIC CENTER- OR CENTRAL BUFFER COUPLINGS FOR RAIL VEHICLES

FIELD OF THE INVENTION

The invention relates to an electrical contact coupling for automatic center- or central buffer couplings for rail vehicles, more particularly for claw couplings with protective arm, rotatable claw and fall bar, of the "AAR" or "Janney" type for example, or with two rigid claws and claw bar, of the "Willison" type for example, with a contact carrier secured to the coupling head and guided so as to be displaceable longitudinally in the longitudinal direction of the central buffer coupling.

BACKGROUND OF THE INVENTION

Cable couplings which are fixedly connected to the mechanical coupling (DE-PS 499 955 or DE-PS 811 360), those which are mounted on the coupling head with a mounting joint so as to be forwardly pivotable (D)E-PS 927 445, DE-PS 10 34 681 or DE-PS 10 21 407) and those which are arranged on the mechanical coupling so as to be displaceable parallel to the longitudinal axis of the coupling (DE 24 14 384 A1, DE-PS 10 71 743 or DE-PS 10 20 361) are well known.

Arrangements with cable couplings guided longitudinally above, to the side of or underneath the coupling head are well known from the last-mentioned specifications. The electrical cable couplings are basically used for power and/or signal transmission.

In general, with automatic center couplings or central buffer couplings, the cable couplings are often also coupled and/or uncoupled automatically as required. The co-coupling of line couplings, more particularly electrical cable couplings, requires that the mechanical coupling represents a rigid system or one which is made rigid, i.e. a rigid and largely play-free coupling connection between two coupling heads is required.

The coupling heads of the mechanical couplings of the specified prior art have at the front end a flat abutting surface or front face, arranged transversely to the longitudinal axis, which comes into contact with the corresponding abutting surface of the mating coupling. An air line coupling is often arranged on or in this abutting surface, this being described in DE 24 14 384 A1 and DE-PS 10 20 361, for example.

For certain types of central buffer couplings, more particularly for claw couplings, of the "AAR" or "JANNEY" type for example, finding a simple and advantageous design and arrangement for a line coupling to be co-coupled is difficult, as these types have no front face or abutting surface on the coupling end oriented transversely to the longitudinal axis. Also, the mechanical coupling heads make transverse movements in the coupling operation which have to be compensated for. Some solutions with their own facilities or carriers for air line couplings of claw couplings of the "Willison" type are known (for example from DE 17 55 354 C3, DE 17 50 231 A1 or DE 16 05 205 A1), but often with these vertical, tall-construction central buffer couplings the necessary installation spaces and clearances for installing an air line coupling and/or an electrical contact coupling are not available or solutions can only be realised with considerable technical effort or economic expenditure and with difficulties or limitations.

SUMMARY AND OBJECTS OF THE INVENTION

The object underlying the invention for an automatic center- or central buffer coupling of the type specified in the introduction, more particularly for claw couplings, is to indicate an economic and flat-construction solution for the design and arrangement of an electrical contact coupling and an air line coupling.

According to the invention, an electrical contact coupling is provided for an automatic center- or central buffer coupling for rail vehicles, more particularly for claw couplings with protective arm, rotatable claw and fall bar, e.g. of the "AAR" or "Janney" type, or with two rigid claws and claw bar, erg. of the "Willison" type, with a contact carrier secured to the coupling head and guided so as to be displaceable longitudinally in the longitudinal direction of the central buffer coupling. The contact coupling has contacts for electrical connections and is displaceable from a rear, uncoupled position into a forward position ready for coupling. The contact carrier is covered in the rear position by a protective flap and is freed in the forward position as the protective flap is swivelled. A longitudinally displaceable contact carrier is arranged underneath and on a supporting unit which for its part is elastically supported on and secured to the coupling head underneath the coupling head. Actuating cylinders are arranged within the supporting unit for the longitudinal displacement of the contact carrier. An air line coupling with an orifice is arranged on the supporting unit in the coupling plane.

The electrical contact coupling supporting unit may have a smaller height measurement, more particularly a smaller height measurement than the contact carrier. A perpendicular distance (A) between the horizontal center longitudinal plane of the air line coupling and the horizontal center longitudinal plane of the contact carrier is preferably about 160 mm.

Centering elements for pre-centering the electrical contact coupling may be arranged on the supporting unit. Centering elements for the precise centering of the contact carrier may also be arranged on the contact carrier. Respective stud/socket arrangements may be provided as the centering elements for pre- and precise centering, a centering socket for precise centering on the contact carrier being associated with the centering pin for pre-centring on the supporting unit on the same side with respect to the perpendicular longitudinal center plane and a centering pin for precise centering on the contact carrier being associated with the centering socket for pre-centering on the supporting unit on the other side of the perpendicular longitudinal center plane, such that in the centering operation a centering pin and a centering socket are arranged on each side of the perpendicular center longitudinal plane.

A last perpendicular row of contacts respectively on the contact surface of the contact carrier is preferably arranged symmetrically on either side of the perpendicular longitudinal center plane of the electrical contact coupling at a distance (B) of about 119 mm.

The usual stud/socket contacts for power and/or signal transmission, data bus/CCTV contacts are preferably also arranged in the contact surface of the contact carrier. The data bus/CCTV contacts may be arranged in the contact surface of the contact carrier, 5 data bus contacts respectively being arranged horizontally in the top and bottom marginal region of the contact carrier and 4 data bus contacts being arranged in the mid-perpendicular, the topmost data bus contact of this perpendicular row preferably being identical to the center data bus contact of the top horizontal row and the bottommost data bus contact of the perpendicular row being identical to the center data bus contact of the bottom horizontal row, such that a contact pattern in the shape of a horizontal H-arrangement of data bus/CCTV contacts is produced. The distance (C) between the top and bottom horizontal row of data bus/CCTV contacts is preferably about 112 mm. A distance (D) between the extreme left and the extreme right data bus/CCTV contact of the top and bottom row is preferably about 219 mm.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
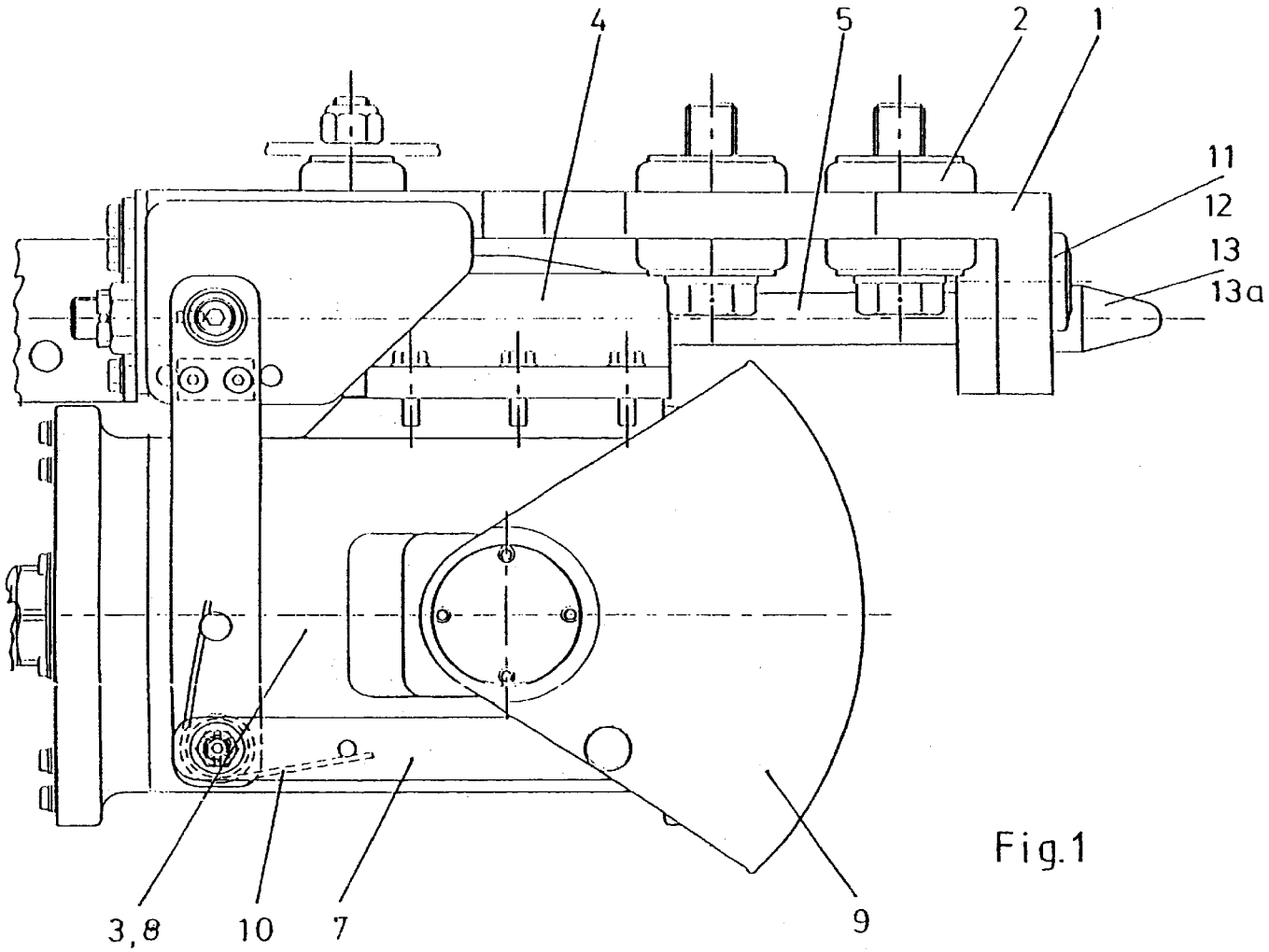
FIG. 1 is a side view of an electrical contact coupling with supporting unit in the uncoupled position.
Figure 2:
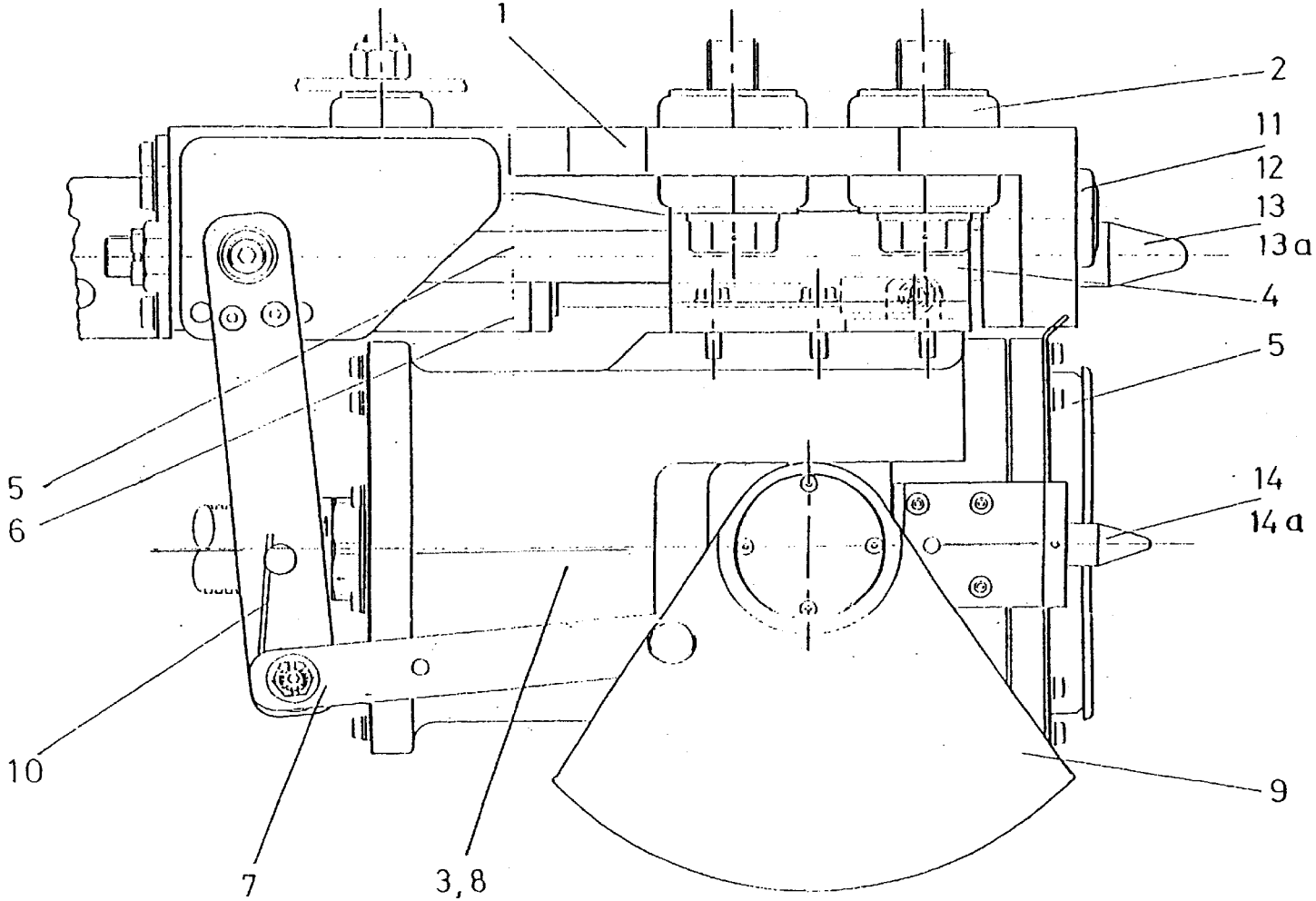
FIG. 2 is a side view of the electrical contact coupling according to FIG. 1 in the advanced position ready for coupling.
Figure 3:
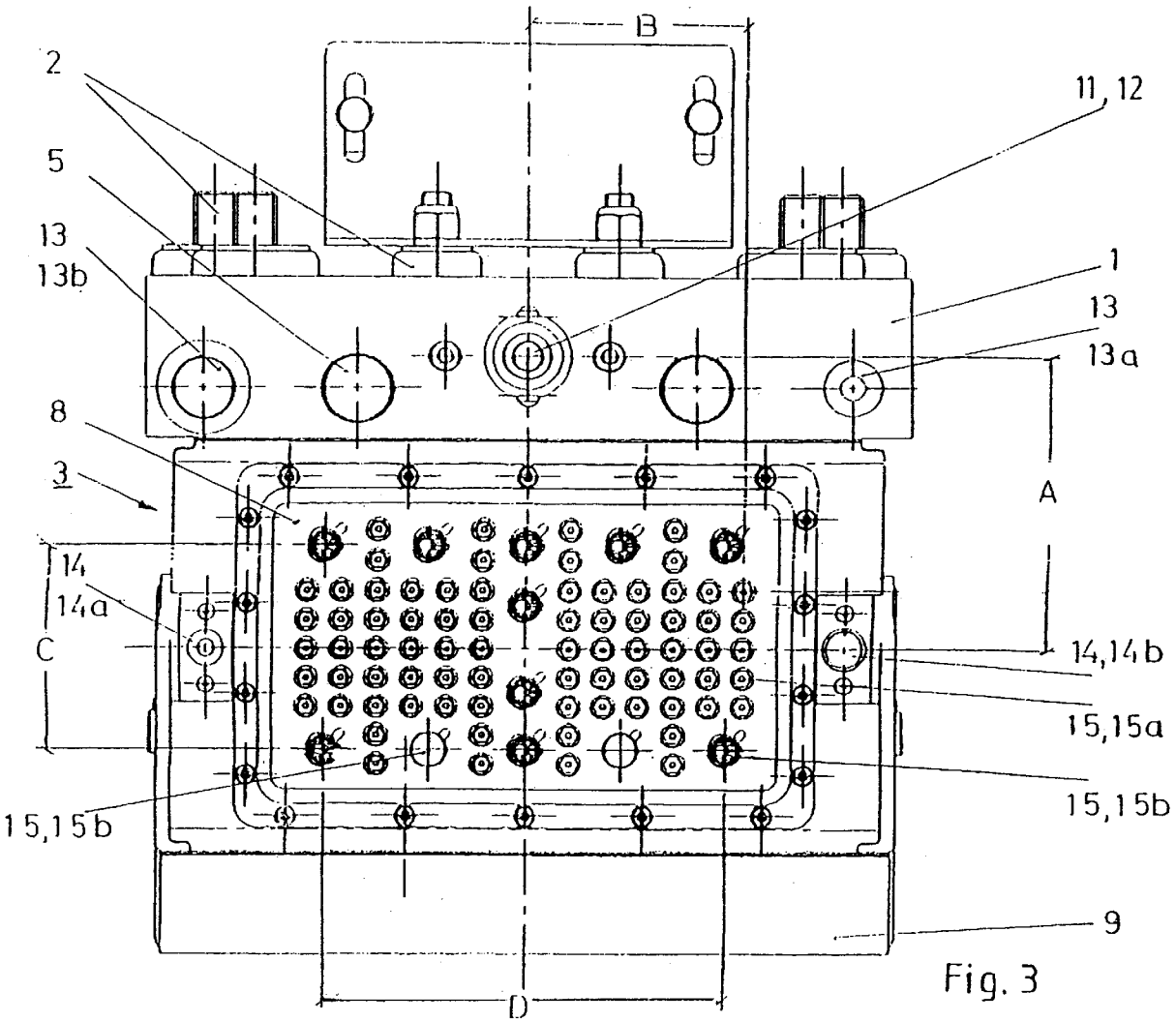
FIG. 3 is a front view showing the electrical contact coupling according to FIG. 2.

Referring to the drawings in particular, a supporting unit 1 is secured underneath a coupling head (not represented) of an automatic center- or central buffer coupling. The securing thereof is effected via elastomeric blocks 2 which enable a fixed but elastic connection to be made between coupling head and supporting unit 1. Underneath the flat-construction supporting unit 1 an electrical contact coupling 3 is guided so as to be displaceable longitudinally in the direction of coupling contact. The electrical contact coupling 3 is displaceable by means of a vehicle carriage 4 which is held so as to be displaceable longitudinally on two guide rods 5 oriented in the longitudinal direction of contact and fixed side by side in the supporting unit 1. The guide carriage 4 and thus the electrical contact coupling 3 secured thereto is displaceable on the guide rods 5 by means of two preferably pneumatically operated actuating cylinders 6. A protective flap 9 attached to the contact carrier 8 so as to be capable of swivelling horizontally is operable via a lever mechanism 7, the protective flap 9 being swivelled in front of the contact carrier 8 when the guide carriage 4 is in the retracted position and being swivelled downwards when it is in the advanced position ready for coupling. The swivelling of the protective flap 9 takes place continuously with the longitudinal movement of the guide carriage 4. The lever mechanism 7 may be tensioned by a spring 10. Arranged at the front end in the perpendicular longitudinal center plane of the supporting unit 1 is the orifice 11 of an air line coupling 12 which in the position ready for coupling is arranged in the coupling plane.

The supporting unit 1 is of a flat construction and has a smaller vertical measurement than the contact carrier 8. The height of the supporting unit 1 is preferably only about half the height of the electrical contact coupling 3.

In order to realize the most flat-construction, compact arrangement and design possible for an electrical contact coupling 3 and an air line coupling 12, particularly for attachment to a central buffer coupling of the previously specified "AAR" or "Janney" type (with protective arm and rotatable claw and fall bar) or Willison type (two rigid claws and a claw bar), the air line coupling 12 is more or less incorporated in the supporting unit 1 for the electrical contact coupling 3. The supporting unit 1 accommodates at the same time in a space saving manner the actuating cylinders 6 arranged horizontally side by side.

The perpendicular distance A between the horizontal center longitudinal plane of the air line coupling 12, which approximately corresponds to the horizontal center longitudinal plane of the supporting unit 1 itself, and the horizontal center longitudinal plane of the contact carrier 8 is about 160 mm.

Centering elements 13 for pre-centering the supporting unit 1 and thus the electrical contact coupling 3 connected thereto are arranged on the supporting unit. Other centering elements 14 for precise centering are arranged on the contact carrier 8.

The centering elements 13, 14 are formed by respective centering pins 13*a*, 14*a* and centering sockets 13*b*, 14*b*, respective centering pins 13*a*, 14*a* engaging in the centering sockets 13*b*, 14*b* of the mating coupling during the coupling operation, i.e. at the longitudinal movement or longitudinal displacement respectively of the supporting unit 1 and the electrical contact coupling 3.

The arrangement of the centering elements 13 and 14 is expediently such that a centering socket 14*b* on the contact carrier 8 is associated with the centering pin 13*a* for pre-centering on the supporting unit 1 on the same side with respect to the perpendicular center longitudinal plane, and that a centering pin 14*a* for precise centering on the contact carrier 8 is associated with the centering socket 13*b* for precentering the supporting unit 1 on the other side of the perpendicular longitudinal center plane. Thus a centering pin 13*a* or 14*a* and a centering socket 14*b* or 13*b* are arranged one underneath the other on each side of the perpendicular longitudinal center plane.

The electrical contacts 15 are arranged in the front part of the contact carrier 8 in the contact surface in accordance with a specific pattern, largely in one plane and transversely to the longitudinal direction of the coupling.

The last perpendicular row of contacts 15 of the contact carrier 8 respectively on either side of the perpendicular longitudinal center plane of the electrical contact coupling are arranged at a distance B of about 119 mm from the longitudinal center plane, a compact construction of the contact carrier 8 being possible with a defined number of contacts 15 of 88 contacts.

As well as being equipped with conventional stud/socket contacts 15*a*, in this case 76 altogether, the contact surface is also designed with special data bus contacts 15*b* and CCTV contacts 15*b* (multimedia and television).

Arranged in the contact surface of the contact carrier 8 are twelve data bus/CCTV contacts 15*b*, five data bus/CCTV contacts 15*b* respectively being arranged horizontally in the top and bottom marginal region of the contact carrier 8 and four data bus/CCTV contacts 15*b* being arranged in the mid-perpendicular, the topmost data bus/CCTV contact 15*b* of this perpendicular row being identical to the center data bus/CCTV contact 15*b* of the top horizontal row and the bottommost data bus/CCTV contact 15*b* of the perpendicular row being identical to the center data bus/CCTV contact 15*b* of the bottom horizontal row, such that, in front view, a contact pattern in the shape of a horizontal H-arrangement of the data bus/CCTV contacts 15*b* is produced.

The distance C between the topmost and the bottommost row of data bus/CCTV contacts 15*b* is about 112 mm.

The distance D between the extreme left and the extreme right data bus/CCTV contact 15*b* on the contact surface of the contact carrier 8 is about 219 mm.

While specific embodiments of the invention have been shown and described in detail to illustrate the application of the principles of the invention, it will be understood that the invention may be embodied otherwise without departing from such principles.

List of Reference Numerals:

1 supporting unit
2 elastomeric block
3 electrical contact coupling
4 guide carriage
5 guide rod
6 actuating cylinder
7 lever mechanism
8 contact carrier
9 protective flap
10 spring
11 orifice
12 air line coupling
13 centering element
14 centering element
13*a* centering pin
13*b* centering socket
14*a* centering pin
14*b* centering socket
15 contact
15*a* stud/socket contact
15*b* data bus/CCTV contact

What is claimed is:

1. An electrical contact coupling for rail vehicles with a coupling head for claw couplings with a protective arm, rotatable claw and fall bar, the coupling comprising:

a supporting unit and an elastic support securing said supporting unit to the coupling head underneath the coupling head;

a contact carrier secured to the coupling head and guided so as to be displaceable longitudinally in a longitudinal direction of a central buffer coupling, said contact carrier having contacts for electrical connections provided on the contact carrier and displaceable from a rear, uncoupled position into a forward position ready for coupling, said contact carrier being arranged underneath and on said supporting unit;

a swivelable protective flap covering the contact carrier in a rear position and being freed in the forward position as the protective flap is swivelled;

actuating cylinders arranged within said supporting unit for the longitudinal displacement of the contact carrier;

an air line coupling with an orifice, said air line coupling being arranged on the supporting unit in the coupling plane.

2. An electrical contact coupling according to claim 1, wherein said supporting unit has a smaller height measurement than the contact carrier.

3. An electrical contact coupling according to claim 1, wherein a perpendicular distance between a horizontal center longitudinal plane of the air line coupling and a horizontal center longitudinal plane of the contact carrier is about 160 mm.

4. An electrical contact coupling according to claim 1, further comprising: centering elements for pre-centering the electrical contact coupling, one of said centering elements arranged on said supporting unit.

5. An electrical contact coupling according to claim 1, further comprising:

centering elements with one said centering elements arranged on the contact carrier.

6. An electrical contact coupling according to claim 1, further comprising centering elements including one centering socket provided for precise centering on the contact carrier associated with a centering pin for pre-centering on the supporting unit on a same side with respect to a perpendicular longitudinal center plane and another centering pin for precise centering on the contact carder associated with another centering socket for pre-centering on the supporting unit on the other side of the perpendicular longitudinal center plane, such that in the centering operation said centering elements are arranged on each side of the perpendicular center longitudinal plane.

7. An electrical contact coupling according to claim 1, wherein said contact of said contact carrier include a last perpendicular row of said contacts respectively on a contact surface of the contact carrier arranged symmetrically on either side of a perpendicular longitudinal center plane of the electrical contact coupling spaced at a distance of about 119 mm.

8. An electrical contact coupling according to claim 7, wherein said contacts include stud/socket contacts for power and/or signal transmission and data bus/CCTV contacts arranged in the contact surface of the contact carrier.

9. An electrical contact coupling according to claim 8, wherein 12 data bus/CCTV contacts are arranged in the contact surface of the contact carrier, 5 data bus contacts respectively are arranged horizontally in a top and bottom marginal region of the contact carrier and 4 data bus contacts are arranged in the mid-perpendicular, with a topmost data bus contact of this perpendicular row being identical to a center data bus contact of the top horizontal row and the bottommost data bus contact of the perpendicular row being identical to the center data bus contact of the bottom horizontal row, such that a contact pattern in the shape of a horizontal H-arrangement of data bus/CCTV contacts is produced.

10. An electrical contact coupling according to claim 9, wherein a distance between a top and bottom horizontal row of data bus/CCTV contacts is about 112 mm.

11. An electrical contact coupling according to claim 9, wherein a distance between an extreme left and an extreme right data bus/CCTV contact of the top and bottom row is about 219 mm.

12. An electrical contact coupling for rail vehicles with a coupling head, the electrical contact coupling comprising:

a supporting unit elastically supported on and secured to the coupling head underneath the said coupling head;

a contact carrier secured to the coupling head and guided so as to be displaceable longitudinally in a longitudinal direction of a central buffer coupling, said contact carrier having contacts for electrical connections provided on the contact carrier and displaceable from a rear, uncoupled position into a forward position ready for coupling, said contact carder being arranged underneath and on said supporting unit;

a swivelable protective flap covering the contact carrier in a rear position and being freed in the forward position as the protective flap is swivelled;

actuating cylinders arranged within said supporting unit for the longitudinal displacement of the contact carrier;

an air line coupling with an orifice, said air line coupling being artanged on the supporting unit in the coupling plane.

13. An electrical contact coupling according to claim 12, further comprising centering elements including one centering socket provided for precise centering on the contact carrier associated with a centering pin for pre-centering on the supporting unit on a same side with respect to a perpendicular longitudinal center plane and another centering pin for precise centering on the contact carrier associated with another centering socket for pre-centering on the supporting unit on the other side of the perpendicular longitudinal center plane, such that in the centering operation said centering elements are arranged on each side of the perpendicular center longitudinal plane.

14. An electrical contact coupling according to claim 12, wherein said contacts include perpendicular rows of said contacts respectively on a contact surface of the contact carrier including a last perpendicular row of contacts arranged symmetrically on either side of a perpendicular longitudinal center plane of the electrical contact coupling spaced at a distance of about 119 mm.

15. An electrical contact coupling according to claim 14, wherein said contacts include stud/socket contacts for power and/or signal transmission and data bus/CCTV contacts arranged in the contact surface of the contact carrier.

16. An electrical contact coupling according to claim 15, wherein 12 data bus/CCTV contacts are arranged in the contact surface of the contact carrier, 5 data bus contacts respectively are arranged horizontally in a top and bottom marginal region of the contact carrier and 4 data bus contacts are arranged in the mid-perpendicular, with a topmost data bus contact of this perpendicular row being identical to a center data bus contact of the top horizontal row and the bottommost data bus contact of the perpendicular row being identical to the center data bus contact of the bottom horizontal row, such that a contact pattern in the shape of a horizontal H-arrangement of data bus/CCTV contacts is produced.

17. An electrical contact coupling according to claim 16, wherein a distance between a top and bottom horizontal row of data bus/CCTV contacts is about 112 mm.

18. An electrical contact coupling according to claim 17, wherein a distance between an extreme left and an extreme right data bus/CCTV contact of the top and bottom row is about 219 mm.

19. An electrical contact coupling for rail vehicles with a coupling head, the electrical contact coupling comprising:

a supporting unit;

an elastomeric block fixing said supporting block to the coupling bead to elastically connect the supporting block to the coupling head underneath the coupling head;

a contact carrier secured to the coupling head and guided so as to be displaceable longitudinally in a longitudinal direction of a central buffer coupling, said contact carrier having contacts for electrical connections provided on the contact carrier and displaceable from a rear, uncoupled position into a forward position ready for coupling, said contact carrier being arranged underneath and on said supporting unit;

a swivelable protective flap covering the contact carrier in a rear position and being freed in the forward position as the protective flap is swivelled;

actuating cylinders arranged within said supporting unit for the longitudinal displacement of the contact carrier;

an air line coupling with an orifice, said air line coupling being arranged on the supporting unit in the coupling plane.

20. An electrical contact coupling according to claim 19, further comprising centering elements including one centering socket provided for precise centering on the contact carrier associated with a centering pin for pre-centering on the supporting unit on a same side with respect to a perpendicular longitudinal center plane and a centering pin for precise centering on the contact carrier associated with a centring socket for pre-centring on the supporting unit on the other side of the perpendicular longitudinal center plane, such that in the centering operation centering elements are arranged on each side of the perpendicular center longitudinal plane.

* * * * *